US006206475B1

(12) United States Patent
Tai

(10) Patent No.: US 6,206,475 B1
(45) Date of Patent: Mar. 27, 2001

(54) INFLATABLE CUSHION WITH A VIBRATION-MESSAGE DEVICE

(76) Inventor: Martin Tai, P.O. Box 96-405, Taipei 106 (TW)

( * ) Notice: Subject to any disclaimer, the term of this patent is extended or adjusted under 35 U.S.C. 154(b) by 0 days.

(21) Appl. No.: 09/507,933

(22) Filed: Feb. 22, 2000

(51) Int. Cl.[7] ..... A47C 7/02
(52) U.S. Cl. ..... 297/452.41; 297/217.3
(58) Field of Search ..... 601/49, 57; 5/674, 5/655.3; 297/452.41, 217.3, 217.1, 260.2, 260.1, 258.1, DIG. 3

(56) References Cited

U.S. PATENT DOCUMENTS 4,099,773 * 7/1978 Chang .
5,713,631 * 2/1998 O'Neill et al. .
5,792,082 * 8/1998 Yamanaka et al. .
6,024,407 * 2/2000 Eakin .
6,042,186 * 3/2000 Kojic et al. .
6,053,880 * 4/2000 Sleichter, III .

* cited by examiner

*Primary Examiner*—Milton Nelson, Jr.
(74) *Attorney, Agent, or Firm*—Dougherty & Troxell

(57) ABSTRACT

An inflatable cushion used as a sitting or lying furniture for people with an inner surface of the seat surface or the back surface of the cushion mounted with a plurality of massage devices. The massage device includes a vibration assembly and conductive wires, which are wrapped in a wrappage member thermo-glued at a given position on the inner surface of the inflatable cushion. The power-supply wires of the wrappage member are connected and glued to a wire-hole base at one side of the inflatable cushion so as to facilitate power-supply connection. The massage device is hung on the inner surface of the inflatable cushion by the wrappage member. During massage operation, the seat surface over the wrappage member will be in close contact with a person's body, and also the inflatable cushion will have a resonant effect to buffer the vibration frequency of the vibration assembly in order to provide a comfortable massage.

2 Claims, 6 Drawing Sheets

INFLATABLE CUSHION WITH A VIBRATION-MESSAGE DEVICE

BACKGROUND OF THE INVENTION

1. Field of the Invention

This invention relates to an inflatable cushion, and particularly to an inflatable cushion with a vibration-massage device.

2. Description of the Prior Art

The conventional inflatable cushion is made of PVC or PU, being thermo-glued together; for a larger cushion, a pull belt is used for connecting the upper part and the lower part thereof so as to prevent the cushion from deformation. The cushion can be formed in different shapes, such as a mattress or a sofa, in accordance with the use desired.

In the chair-massage cushion, several massage devices are mounted on the inner surface of the back surface of the chair cushion; every massage device has its power supply wires connected to the outer part thereof. The operation massage device is controlled with a controller, and the back of a person will be massaged upon contacting with the cushion.

The conventional chair-massage cushion is made of an artificial leather; a massage device can be mounted directly on the inner surface of the back surface, or mounted in a sponge. As soon as the artificial leathers are sewed up, the chair-massage cushion will be ready for operation. The same structure can be used for a massage mattress.

A conventional chair-massage cushion has a back surface with a small hole for mounting a vibration device; the inner surface of the back surface has a piece of leather for wrapping up a vibrator; the power-supply wires of the vibrator are pulled out of the small hole. When the back surface of the chair-massage cushion is mounted with several vibrators, the power-supply wires thereof will also be pulled out of the small hole, i.e., the back surface is laid with a plurality of power-supply wires.

SUMMARY OF THE INVENTION

The prime object of the present invention is to provide an inflatable cushion for a person to sit or to lie on. The inner surfaces of the seat surface and the back surface of the cushion are mounted with at least two massage devices respectively. The lower piece of the wrappage member of the massage device has a thermo-glued surface to be glued together with the inner surface of the back surface so as to have the vibration assembly hung upon a spot to provide massage. The power-supply wires of the vibration assembly are pulled out of a wire-hole base through an extension belt at one side of the wrappage member, and then the belt is glued to the wire-hole base so as to facilitate the power-supply wires to pull out of cushion.

Another object of the present invention is to provide an inflatable cushion, in which the wrappage member of the massage device includes a top piece and a lower piece; the top and lower pieces are formed into a guide tube by gluing the thermo-glued lines together in parallel. On the vibrator, the cover surface of the top piece is smaller than that of the lower piece; after the two cover surfaces are glued together, the power-supply wires are pulled out of the extension belt.

Still another object of the present invention is to provide an inflatable cushion, in which the wrappage member includes an upper cover surface and a lower-cover surface; the edge part of the lower piece is larger than that of the top piece; the large portion of the edge part is used as a thermo-glued surface upon the wrappage member being glued to the inner surface of the back surface; after the thermo-glued surfaces are glued together, the vibration assembly will be hung at a given position on the inner surface of the back surface.

A further object of the present invention is to provide an inflatable cushion, in which the back surface of the cushion can be mounted with several massage device; in that case, the top and lower pieces for wrapping the vibration assembly are furnished with cover surfaces for thermo-glued connection so as to have several vibrators wrapped in serial bags; then, the outer edge of the thermo-glued surface of the cover surface of the vibration assemblies is glued with the inner surface of the back surface so as to facilitate the back surface to be mounted with several massage devices simultaneously.

A still further object of the present invention is to provide an inflatable cushion, in which the massage device glued on the inner surface of the back surface is furnished with an extension belt to enable the power-supply wires of the vibration assembly to be pulled out; the end of the extension belt is thermo-glued to a wire-hole base so as to have the power-supply wires pulled out without affecting the perfectness of the back surface of the cushion.

Yet another object of the present invention is to provide an inflatable cushion, in which the vibration assembly in the wrappage member will vibrate upon a person's back being in close contact with the back surface of cushion; in addition, the space between the cushion pieces will also have a resonant effect to buffer the vibration frequency of the vibration assembly in order to provide a comfortable massage effect.

DETAILED DESCRIPTION OF THE PREFERRED EMBODIMENT

Figure 1:
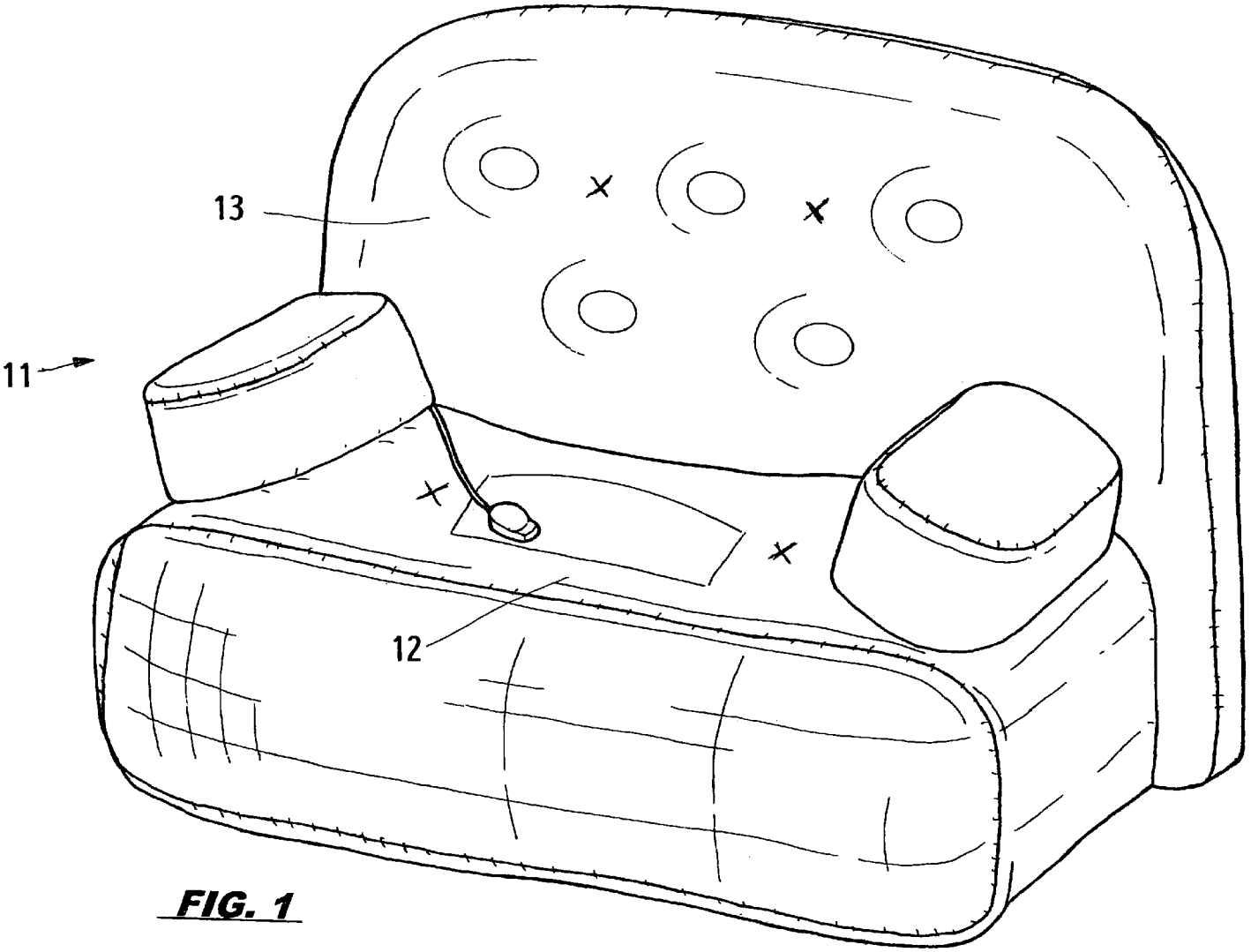
FIG. 1 is a perspective view of the present invention, showing the outer shape of the inflatable cushion.
Figure 3:
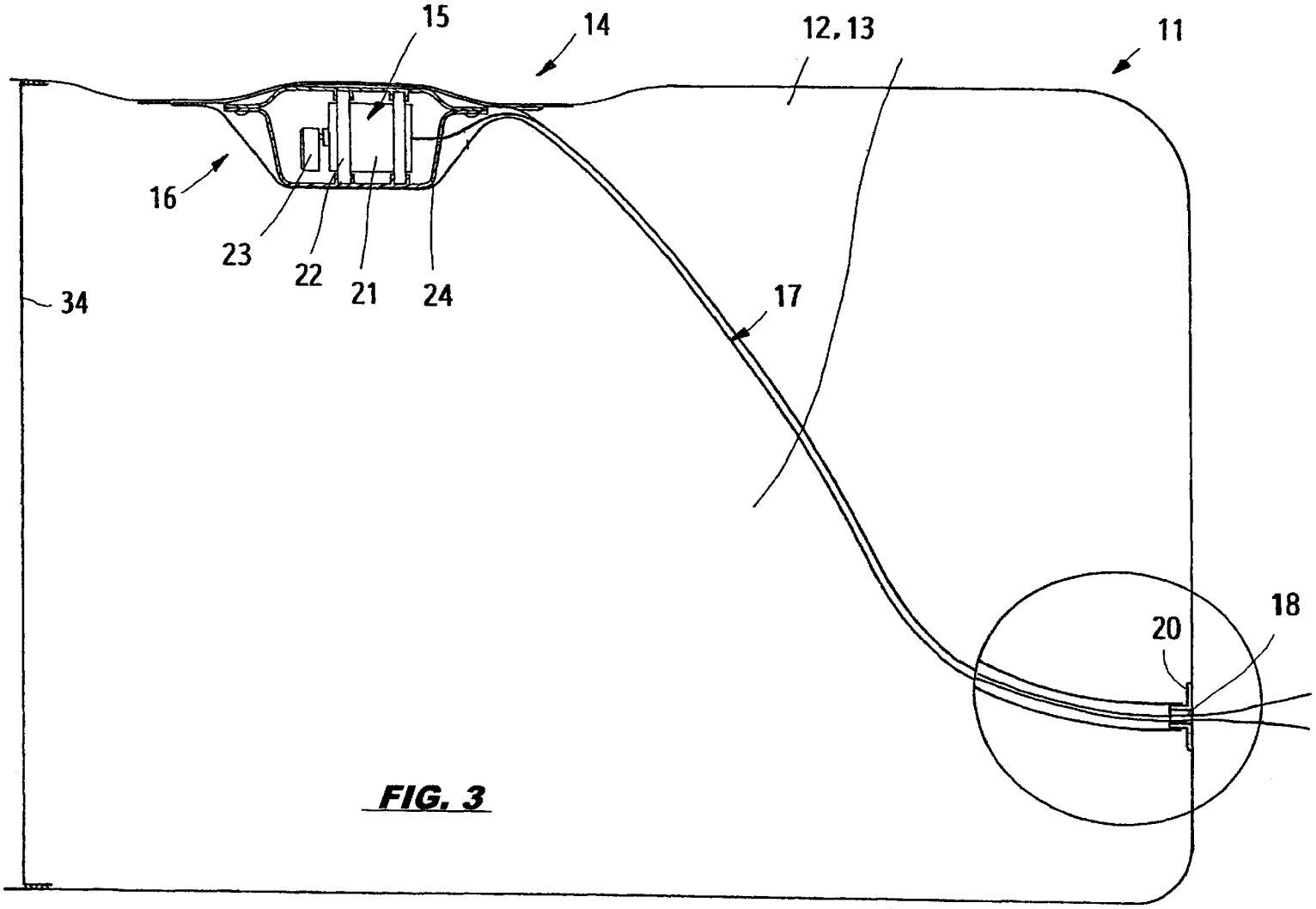
FIG. 3 is a sectional view of the present invention, showing the massage device mounted in the inflatable cushion.
Figure 4:
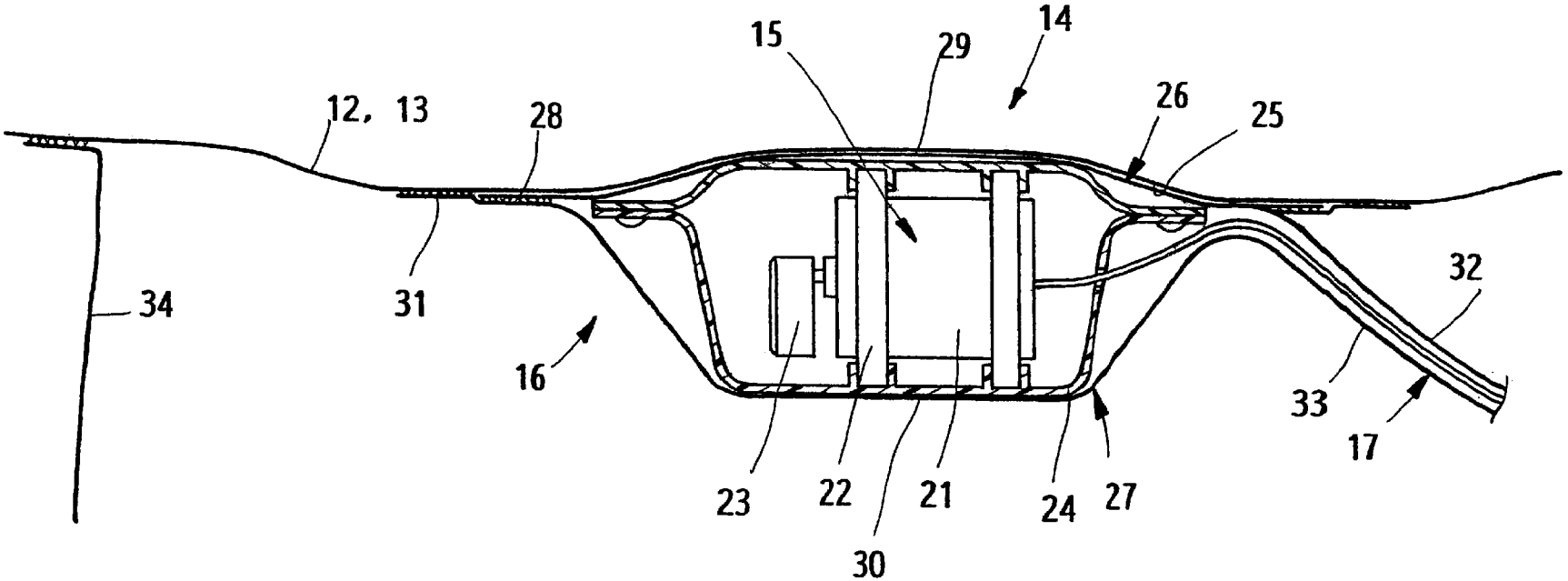
FIG. 4 is a sectional view of the present invention, showing the relation among the parts of the massage device.
Figure 5:
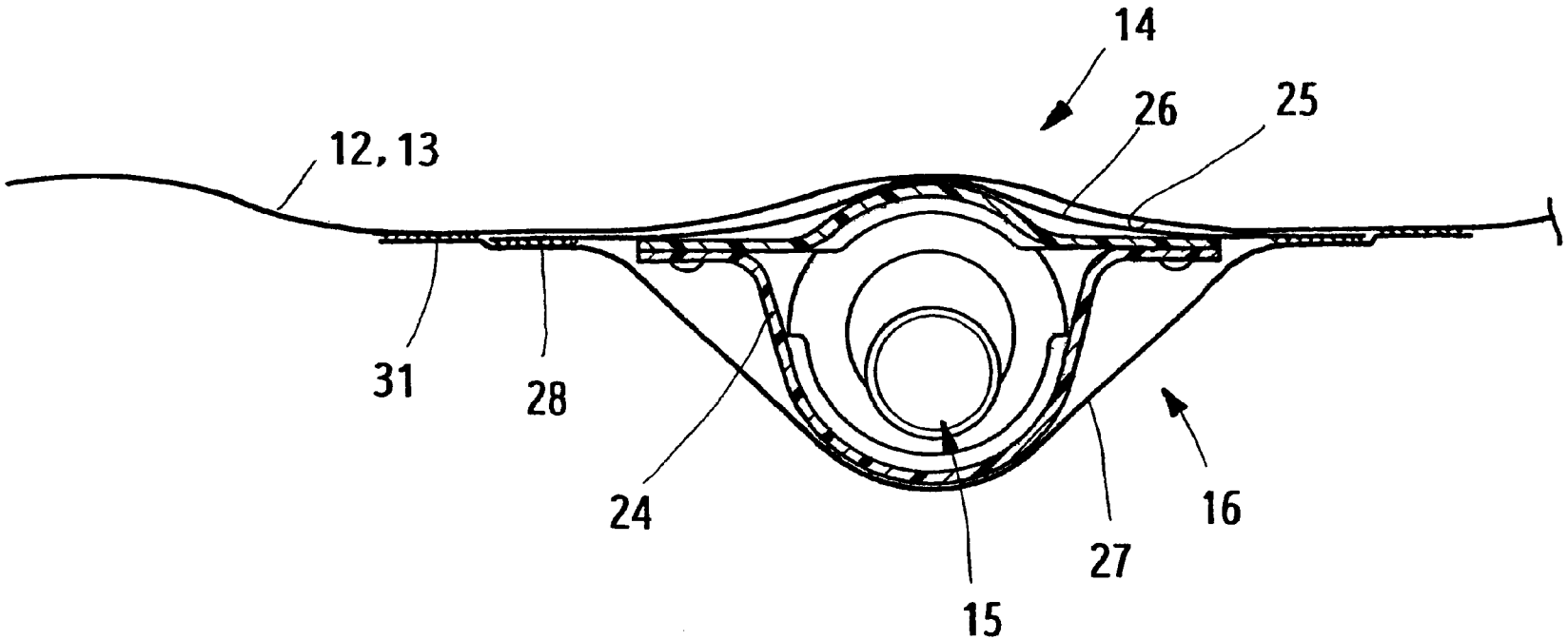
FIG. 5 is a sectional view of the present invention, showing the relation among the parts of the massage device.

This invention relates to an inflatable cushion 11 with a vibration-massage device; as shown in FIGS. 1 and 3, the inflatable cushion 11 is made of a plurality of PVC piece (PU may also be used) connected together by means of a thermo-glued method to form into a shape desired, and the inflatable cushion can be used for sitting or lying by a person. The inflatable cushion 11 is substantially a sofa, of which the upper parts and lower parts of the seat surface 12 and the back surface 13 are furnished with a plurality of pull belts 34 so as to prevent the inflatable cushion from deformation upon being inflated. The inner surfaces 25 of the seat surface 12 and the back surface 13 are glued with massage devices 14 (being shown with a mark "X" in FIG. 1) respectively. The massage device 14 has an extension belt 17 extended to a wire hole 18 so as to facilitate wires for controlling the massage device 14 to lead out. The massage device 14 is controlled with a controller for vibration.

The massage device 14 mounted on the inner surface 25 of the seat surface 12 or the back surface 13 of the inflatable cushion 11 includes a vibration assembly 15, a top piece 26, and a lower piece 27; the vibration assembly 15 includes a motor 21, a vibrator 23, a support frame 22 and a fixture box 24; the vibrator 23 is substantially an eccentric hammer mounted to a shaft on a the front end of the motor 21. When the motor 21 rotates, the vibrator 23 will provide a centrifugal force to convert into a vibration at a given frequency. The support frame 22 is a round frame to be mounted around the motor 21 and to be fitted in the fixture box 24 so as to have the motor 21 fastened in place. The fixture box 24 includes two foldable plates or two cover plates so as to contain the motor 21 therein. The outer lid of the fixture box 24 is substantially a flat and smooth plate to be glued on the seat surface or the back surface of the inflatable cushion as well as the wrappage member 16 so as to provide a user with a comfortable sitting or sitting against the back surface.

The vibration assembly 15 of the massage device 14 can vibrate only when the power supply is turned on; the vibration assembly 15 is fixedly fastened on the inner surface 25 of the seat surface 12 (or the back surface 13) of the inflatable cushion 11. The power-supply wire is led out between the top piece 26 and the lower piece 27 in a sealed manner; the top piece 26 and the lower piece 27 are fastened together by means of the thermo-glued line 28; the leading-out part of the power-supply wire is connected fixedly with the wire-hole base 20 by means of thermo-glued method. After the power-supply wire is pulled out of the wire hole 18, and is connected with a power supply, the controller will actuate the vibration assembly 15 to provide a vibration at a given frequency.

The vibration assembly 15 is wrapped up with the top piece 26 and the lower piece 27; the top piece 26 includes a cover surface 29 and a belt 32. The inner surface of the cover surface 29 is a flat and smooth surface, while the outer surface thereof is a surface with course granules. The material thereof is the same as that of the seat surface 12. The lower piece 27 includes a cover surface 30 and a belt 33, which is the same as the belt 32 of the top piece 26; the edge part of the cover surface 30 is larger than that of the top piece 26 so as to have sufficient area to wrap up the fixture box 24 of the vibration assembly 15, and to have a wide portion used as a thermo-glued surface 31, which is to be glued together with the inner surface 25 of the seat surface 12 (or back surface 13) of the inflatable cushion 11 of the massage device 14.

Figure 2:
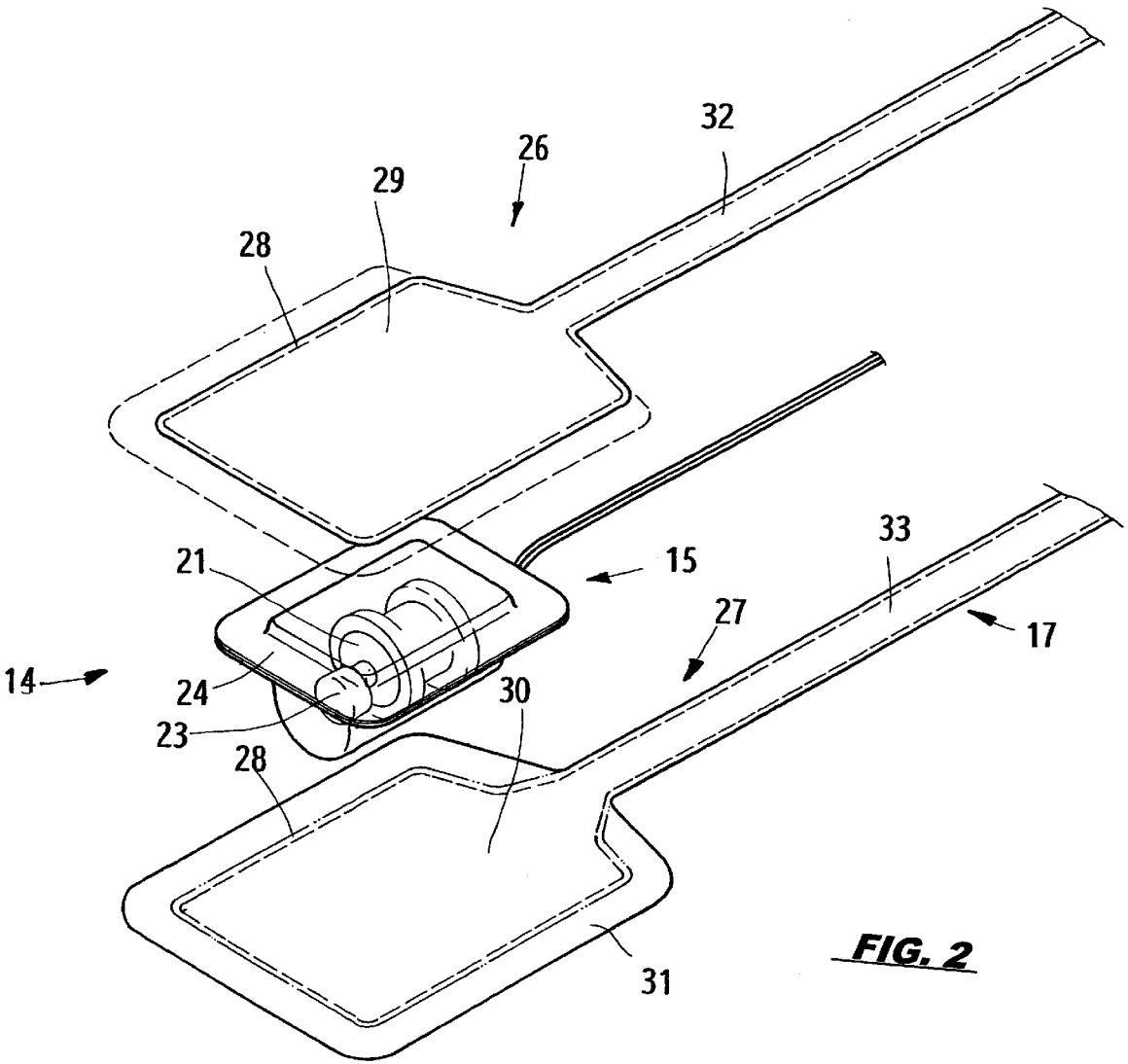
FIG. 2 is a disassembled view of the present invention, showing the relation among the parts of the massage device.

The vibration assembly 15 (including power-supply wires) is to be wrapped up with the top and lower pieces 26 and 27 to form into a wrappage member 16, which can be manufactured in a mode of mass production; in that case, a lower piece 27 having a given size can be put in a mold with a thermo-glued line 28 and a cutter, and then a vibration assembly 15 (including power-supply wires) is also put in the mold; then, a top piece 26 is put on the upper part of the mold; after pressure and heat are applied to the mold, the vibration assembly 15 (including power-supply wires) will be wrapped up by means of the top and lower pieces to form into a thermo-glued line 28. The material extended out of the thermo-glued line 28 between the belt 32 and belt 33 will be cut off with a heat cutter. The material extended out of the cover surfaces 29 and 30 will be cut off with a cold cutter. The massage device 14 demolded has been assembled together with the vibration assembly 15 and the power-supply wire. The edge part of the cover surface 29 of the top piece 26 is the same as that of the therrno-glued surface 31 of the lower piece 27; the surplus edge part outside the thermo-glued line 28 on the top piece 26 has to be cut off (i.e., the doted line of the edge of the thermo-glued line 28 as shown in FIG. 2) so as to facilitate the outer edge of the thermo-glued line of the lower piece 27 to be used as a thermo-glued part upon the inner surface 25 of the seat surface 12 (or back surface 13) of the inflatable cushion 11 to be glued together with the massage device 14.

Before the wrappage member 16 being thermo-glued with the seat surface 12 (or back surface 13) of the inflatable cushion 11, the vibration assembly 15 (including power-supply wires) wrapped up with the top piece 26 and the lower piece 27 is substantially an independent wrappage member 16, which has a sealed space within the thermo-glued line 28. The space between the belt 32 and the belt 33 is formed into an extension belt 17 for the power-supply wire. The part of the extension belt 17 and the wire-hole base 20 glued to the inflatable cushion 11 are connected together by means of thermo-glued method so as to have the power-supply wire of the vibration assembly 15 led out before the inflatable cushion 11 being glued. The thermo-glued surface 31 of the outer edge of the cover surface 30 of the wrappage member 16 is thermo-glued with the inner surface 25 of the seat surface 12 (or the back surface 13); after all the seat surfaces 12 (or the back surfaces 13) are glued into an inflatable cushion 11, the massage device 14 will be fastened on the inner surface 25 of the seat surface 12 (or the back surface 13) of the inflatable cushion 11 simultaneously. As soon as the inflatable cushions 11 are assembled into a sofa having a back member, the massage device 14 will be attached and hung on the inner surface 25 of seat surface 12 (or the back surface 13) of a sofa. After the power-supply wire in the extension belt 17 of the vibration assembly 15 is connected with a power supply, and the controller thereof is adjusted properly, the vibration assembly will provide a vibration at a given frequency for massage to a person. The vibration assembly 15 on the inner surface 25 of the seat surface 12 of a sofa is mounted on a horizontal level, it not only can provide a massage for a person's body, but also can provide a resonant effect with the inflatable cushion so as to buffer the vibration frequency of the vibration assembly 15 in order to provide a comfortable massage effect.

Figure 6:
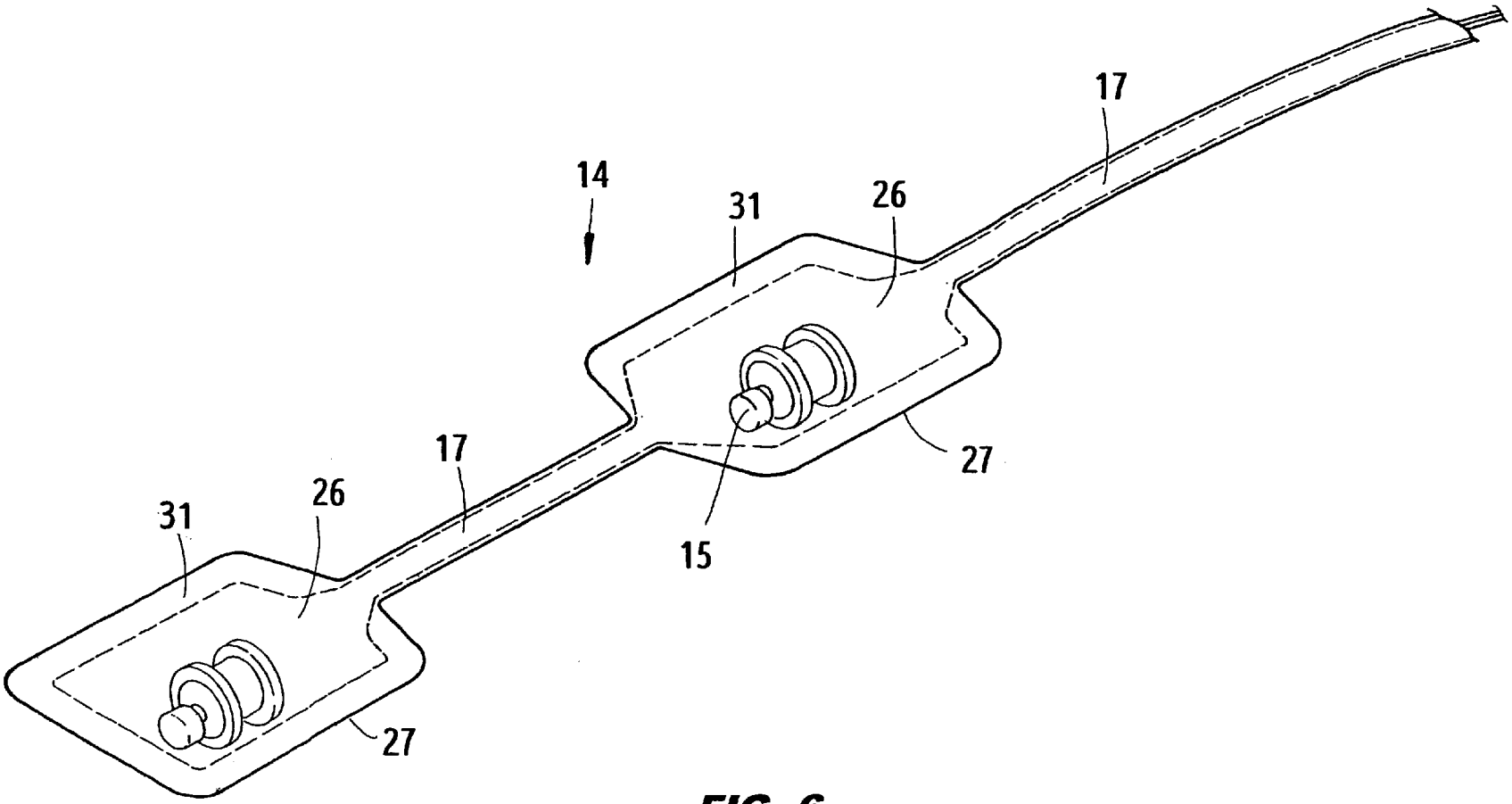
FIG. 6 is a perspective view of the present invention, showing a plurality of vibrators mounted in one bag.

The massage device 14 of the present invention includes a vibration assembly 15 wrapped up with the top and lower pieces 26 and 27 by means of thermo-glued method, and the power-supply wire is pulled out of the wire hole 18 to the wire-hole base 20 by means of the extension belt; as shown in FIG. 6, the massage device 14 includes two vibration assemblies 15, which are wrapped up with a strip of top and lower pieces 26 and 27 respectively; the extension belt between two vibration assemblies 15 is used for wrapping power-supply wires. The thermo-glued surface 31 on the edge of the vibration assembly 15 will be glued to the inner surface 25 of the seat surface 12. The end of the extension belt 17 is thermo-glued with the wire-hole base 20; likewise, the controller is used for adjusting the vibration frequency of the vibration assembly 15.

According to the aforesaid description of the embodiment, the present invention has fully disclosed the features and structure thereof, and it is apparent that the present invention has provided a prominent improvement for the device of the kind, which is never anticipated and accomplished by any person in that field; further, the structure of the present invention is also deemed unique.

What is claimed is:

1. An inflatable cushion with a vibration-massage device comprising an inflatable cushion for a person to sit or to lie upon with a seat surface and a back surface, inner surfaces of said seat surface and said back surface of said inflatable cushion having massage devices mounted thereon, respectively, and each of said massage devices including:

a vibration assembly including a fixture box with a support frame mounting a motor and a vibrator; and power-supply wires of said motor extending out of said fixture box a predetermined length;

a top piece and a lower piece wrapped over an upper side and a lower side of said vibration assembly and thermo-glued together; said top piece including a top cover surface and a top belt, an inner surface of said cover surface having a flat and smooth surface;

said lower piece including a lower cover surface and a lower belt, a width and a length of said lower belt being the same as that of said top belt, an edge part of said lower cover surface being larger than that of said top cover surface so as to form a portion glued with said inner surface of said inflatable cushion in order to mount said massage device on said inner surface; and, a wire-hole base glued on said inner surface of said inflatable cushion, and having a short stub affixed with one end of an extension belt formed by said top belt and said lower belt.

2. The inflatable cushion with a vibration-massage device as claimed in claim 1, wherein each massage device has at least two vibration assemblies, and further comprising one top cover surface and one lower cover surface for each vibration assembly, each lower cover surface being thermo-glued to said inner surface.

* * * * *